US006580040B2

(12) United States Patent
Konda

(10) Patent No.: US 6,580,040 B2
(45) Date of Patent: Jun. 17, 2003

(54) BREAKER DEVICE

(75) Inventor: Kazumoto Konda, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/011,814

(22) Filed: Dec. 11, 2001

(65) Prior Publication Data

US 2002/0096419 A1 Jul. 25, 2002

(30) Foreign Application Priority Data

Jan. 23, 2001 (JP) ..... 2001-014990

(51) Int. Cl.[7] ..... H01H 15/00

(52) U.S. Cl. ..... 200/17 R; 200/16 E; 200/43.05; 200/561; 337/9

(58) Field of Search ..... 200/17 R, 16 E, 200/18, 43.05, 558, 561, 253.1, 254, 51.12, 401, 404; 337/1, 4, 5, 9, 142, 186, 194, 208; 439/261

(56) References Cited

U.S. PATENT DOCUMENTS 5,406,449 A * 4/1995 Hicks et al. ..... 200/43.05
5,831,228 A 11/1998 Kuki et al. ..... 200/16 E
5,842,560 A 12/1998 Kuki et al. ..... 200/43.05
5,847,338 A * 12/1998 Kuki et al. ..... 200/17 R
6,337,448 B1 * 1/2002 Konda ..... 200/17 R
6,459,354 B2 * 10/2002 Konda et al. ..... 337/9

FOREIGN PATENT DOCUMENTS

JP A 9-223439 8/1997 ..... H01H/31/32

* cited by examiner

*Primary Examiner*—Michael Friedhofer
(74) *Attorney, Agent, or Firm*—Oliff & Berridge PLC

(57) ABSTRACT

In this breaker device, a pair of stationary electrodes (35, 35) are arranged while the protruding wall (32) is interposed between them and the U-shaped movable electrode (60) is engaged with them so as to close an electric circuit. The protective protruding section (61) is arranged at an upper end of the stationary electrode (35), and the protrusions (62) are provided on both sides of the protective protruding section (61). When the movable electrode (60) is engaged, it is elastically expanded and deformed when it comes into contact with the protrusion (62). Even in a case in which the protrusion (62) is scraped away by the friction caused between the protrusion (62)and the movable electrode (60), since the protrusion (62) is located at a position shifted from the stationary electrode (35), the scraped powder never gets into between the movable electrode (60) and the stationary electrode (35).

4 Claims, 7 Drawing Sheets

BREAKER DEVICE

BACKGROUND OF THE INVENTION

1. Technical Field

The present invention relates to a breaker device used for switching a power cable, which is connected to a battery of an automobile, between an electrical-continuity state and an electrical-non-continuity state.

2. Related Art

Concerning this type breaker device, a breaker device disclosed in the Unexamined Japanese Patent Publication No. Hei9-223439 is well known. As shown in FIG. 7, this breaker device is composed as follows. In the breaker body 1, there are provided two columnar stationary electrodes 2, 2 which rise from the breaker body 1. These stationary electrodes 2, 2 are engaged with a pair of cylindrical leg sections 5, 5 provided in a movable electrode 4, so that an electrical cable C can be switched between an electrical-continuity state and an electrical-non-continuity state.

Problems to be Solved

However, the above breaker device is composed in such a manner that the stationary electrodes 2, 2 are separately raised. Therefore, it is difficult to meet a demand to downsize the breaker device. In order to solve the above problems, the present applicant is developing a breaker device composed as follows. As shown in FIG. 8, a pair of stationary electrodes 6, 6 are arranged on the front and the back side of the protruding wall 7 which is made of resin and raised from the breaker body so that the breaker device can be downsized, and a gate-shaped movable electrode 8 is put on this protruding wall 7. Due to the foregoing, a pair of leg pieces 8A, 8A arranged in the movable electrode 8 are made to come into contact with the stationary electrodes 6, 6, so that both the stationary electrodes 6, 6 can be switched between an electrical-non-continuity state and an electrical-continuity state.

However, according to the structure in which the stationary electrodes 6 are only arranged on the front and the back side of the protruding wall 7, there is a possibility that when a worker's finger or an foreign matter gets into the breaker device from an upper opening portion, it comes into contact with a forward end of the stationary electrode 6. In order to prevent the occurrence of the above problem, it is possible to consider an arrangement in which the protective protruding section 9A is integrally arranged at an upper end of the protruding wall 7 as shown in FIG. 8, so that an upper portion of the stationary electrode 6 can be covered.

However, when the above arrangement is adopted, the following problems may be encountered. In the above arrangement, when the movable electrode 8 is inserted into the stationary electrodes 6, forward end portions of the leg pieces 8A strongly rub the protective protruding section 9A. Therefore, a surface of the protective protruding section 9A is scraped off by the leg pieces 8A, and the thus scraped resin powder gets into between the stationary electrode 6 and the leg pieces 8A. Accordingly, the electrical contact becomes unstable.

SUMMARY OF THE INVENTION

In view of the above circumstances, the present invention has been accomplished. It is an object of the present invention to provide a breaker device characterized in that: the size of breaker device can be reduced; it is possible to prevent a worker's finger or a foreign matter from carelessly coming into contact with the stationary electrode; and an electrical contact of the stationary electrode with the movable electrode can be made stable.

Means for Solving the Problems

A breaker device according to aspect 1 comprises: a pair of stationary electrodes arranged on both sides of an insulating protruding wall; and a movable electrode for short-circuiting the stationary electrodes to each other by putting the movable electrode on the stationary electrodes from a forward end side of the protruding wall, wherein an insulating protective protruding section for covering a forward end face of the stationary electrode from the forward end side of the protruding wall is provided at the forward end of the protruding wall, and a protrusion for expanding the movable electrode is provided in the forward end of the protruding wall or the movable electrode at a position shifted from the stationary electrode.

A breaker device according to aspect 2 is characterized in that the protrusion is formed protruding from the forward end of the protruding wall in a direction so that the protrusion can be more separate from a face of the stationary electrode than the protective protruding section. A breaker device according to aspect 3 is characterized in that the protrusion is formed in the movable electrode while the protrusion is protruding onto the protruding wall side.

The invention described in aspect 4 provides a breaker device according to one of aspects 1 to 3, wherein the protrusion is provided on both sides of the stationary electrode in the width direction.

Aspect 1

According to the arrangement of aspect 1, a pair of stationary electrodes are collected in a portion while a protruding wall is interposed between them. Therefore, the structure in the periphery of the stationary electrodes is composed so compact that the breaker device can be downsized. Further, since the insulating protective protruding section to cover a forward end face of the stationary electrode is provided at the forward end portion of the protruding wall, even if a worker's finger or a foreign matter enters the breaker device from an upper portion of the stationary electrode, it is possible to prevent it from coming into contact with the stationary electrode. Furthermore, a protrusion to expand the movable electrode is provided on the protruding wall or the movable electrode. Therefore, when the movable electrode is put on, the movable electrode is elastically deformed by this protrusion so that the movable electrode can be separate from the protective protruding section. At this time, in the case of the arrangement of aspect 2 in which the protrusion is formed on the protruding wall, it can be considered that the protrusion is scraped off by the friction caused between the movable electrode and the protrusion. However, the protrusion is formed at a position shifted from the stationary electrode with respect to the inserting direction of the movable electrode. Therefore, even if powder of resin is generated when the protrusion is scraped off, there is no possibility that the powder of resin is interposed between the stationary and the movable electrode. Accordingly, there is no possibility that an electrical contact of the stationary electrode with the movable electrode becomes unstable.

In the case of the arrangement of aspect 3 in which the protrusion is formed on the movable electrode, it can be considered that the protrusion is scraped off by the friction caused between the movable electrode and the protrusion. However, the protrusion is formed at a position shifted from the stationary electrode with respect to the inserting direction of the movable electrode. Therefore, even if powder of resin is generated when the protrusion is scraped off, there is no possibility that the powder of resin is interposed between the stationary and the movable electrode. Accordingly, there is no possibility that an electrical contact of the stationary electrode with the movable electrode becomes unstable.

Aspect 4

In the case of the arrangement of aspect 4, protrusions are located on both sides of the stationary electrode with respect to the width direction. Therefore, it is possible to stably lift the movable electrode from the protective protruding section, so that the movable electrode can be smoothly inserted.

DETAILED DESCRIPTION OF THE PREFERRED EMBODIMENTS

Referring to FIGS. 1 to 5, an embodiment of the present invention will be explained below. A breaker device of the present invention is arranged in the middle of a power cable of an electric automobile and used for switching the power cable between an electrical-continuity state and an electrical-non-continuity state.

Figure 1:
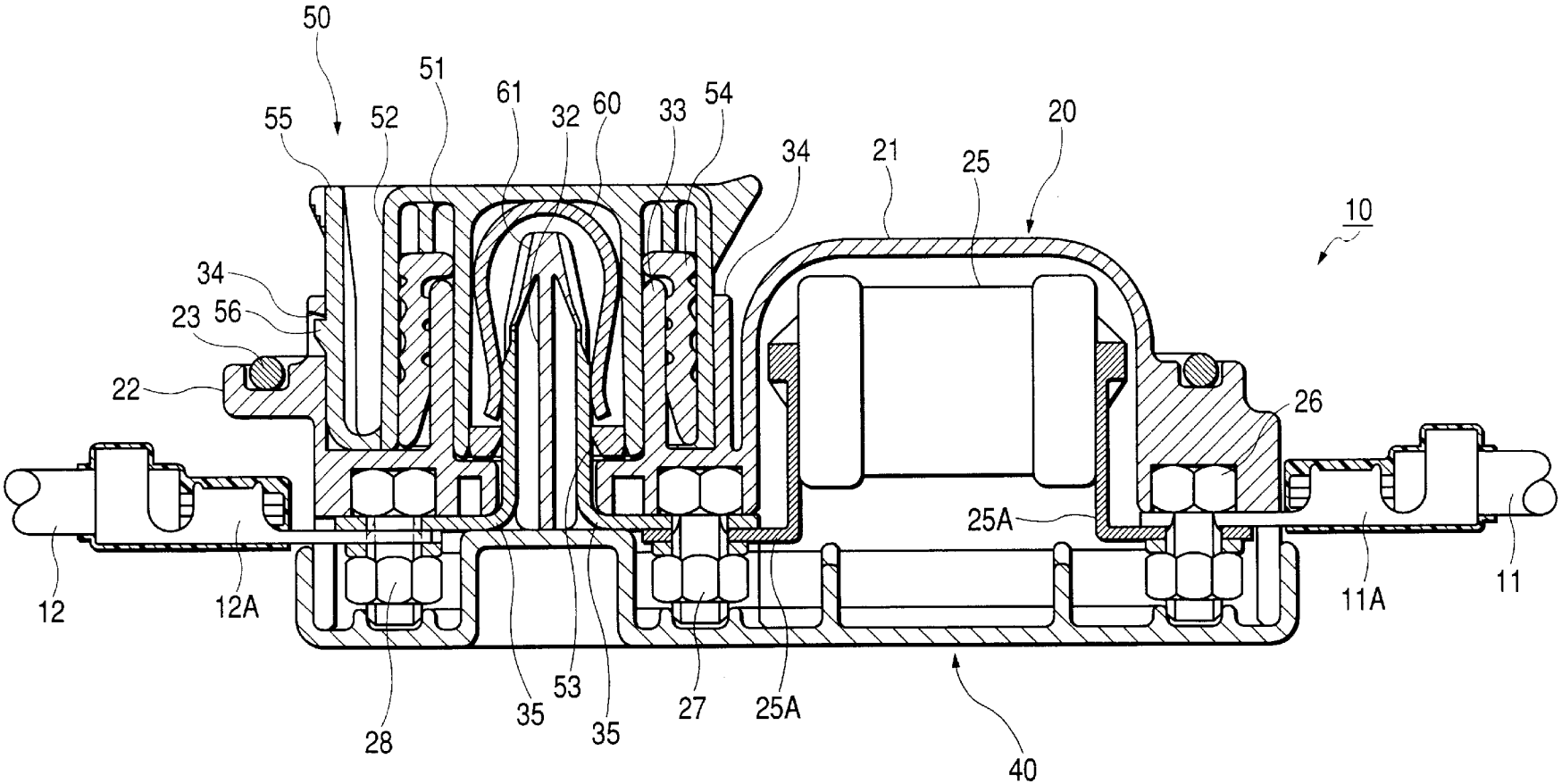
FIG. 1 is a longitudinal cross-sectional view of a breaker device of an embodiment of the present invention.
Figure 3:
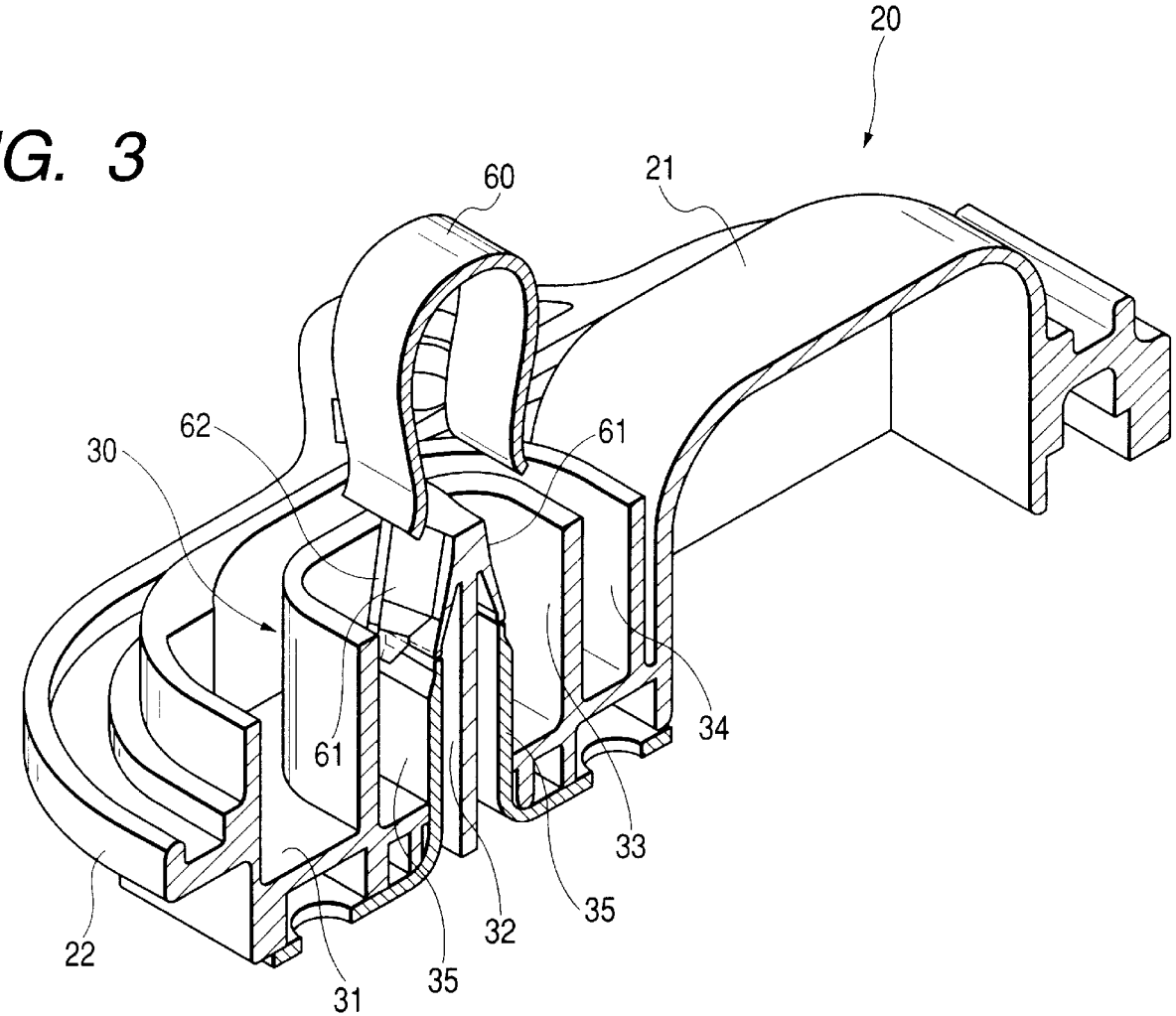
FIG. 3 is a partial perspective view of an upper housing of an embodiment of the present invention.
Figure 4:
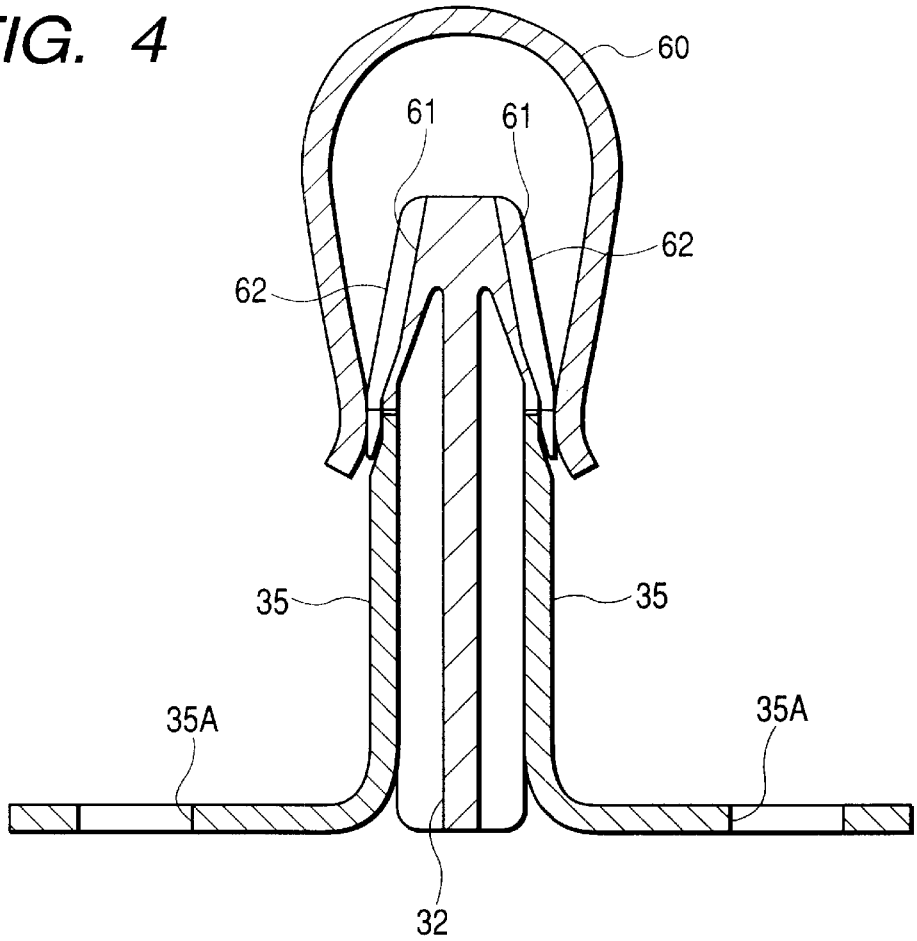
FIG. 4 is a partially enlarged cross-sectional view showing circumstances immediately before a movable electrode comes into contact with a stationary electrode of an embodiment of the present invention.

The housing 10 provided in this breaker device is composed of an upper housing 20 and a lower housing 40. As shown in FIG. 3, the upper housing 20 includes: a fuse cover section 21 for covering a fuse, which will be described later, from the top; and a breaker section 30, wherein the fuse cover section 21 and the breaker section 30 are integrally formed by means of plastic molding. The fuse cover section 21 and the breaker section 30 are laterally arranged, and the rectangular-plate-shaped flange section 22 surrounds the fuse cover section 21 and the breaker section 30. On an upper face of the flange section 22, there is provided an O-ring accommodation groove 24, the profile of which is annular, in which the O-ring 23 (Only a portion of the O-ring 23 is shown in FIG. 1.) is accommodated. At the center of the breaker section 30, the protruding wall 32 integrally rises from the base section 31. The protruding wall 32 is surrounded by the guide cylinder 33. Further, on the outer circumference of the guide cylinder 33, there is provided an engaging cylinder 34 which is concentrically formed by integral molding.

In the fuse cover section 21, there is provided a fuse 25. The L-shaped lead pieces 25A are fixed at both ends of the fuse 25. The terminal 11A arranged at an end of the power cable 11 is fixed at one of the lead pieces 25A, and the other of the lead pieces 25A is jointly fastened to one piece of the stationary electrode 35, which will be described later, by the bolt and nut 27.

On the front and the back face of the protruding wall 32 which are directed in the longitudinal direction of the housing 10 (in the traverse direction of FIG. 1), two stationary electrodes 35 are arranged in such a manner they interpose the protruding wall 32. Each stationary electrode 35 is formed when a metallic plate is bent into an L-shape. On the base end side of the stationary electrode 35, there is formed a bolt insertion hole 35A. The stationary electrode 35 on the left of FIG. 1 is jointly fastened together with the terminal 12A, which is arranged at an end of the power cable 12, by the bolt and nut 28. The stationary electrode 35 on the right of FIG. 1 is jointly fastened together with the lead piece 25A of the fuse 25 as described before.

Figure 2:
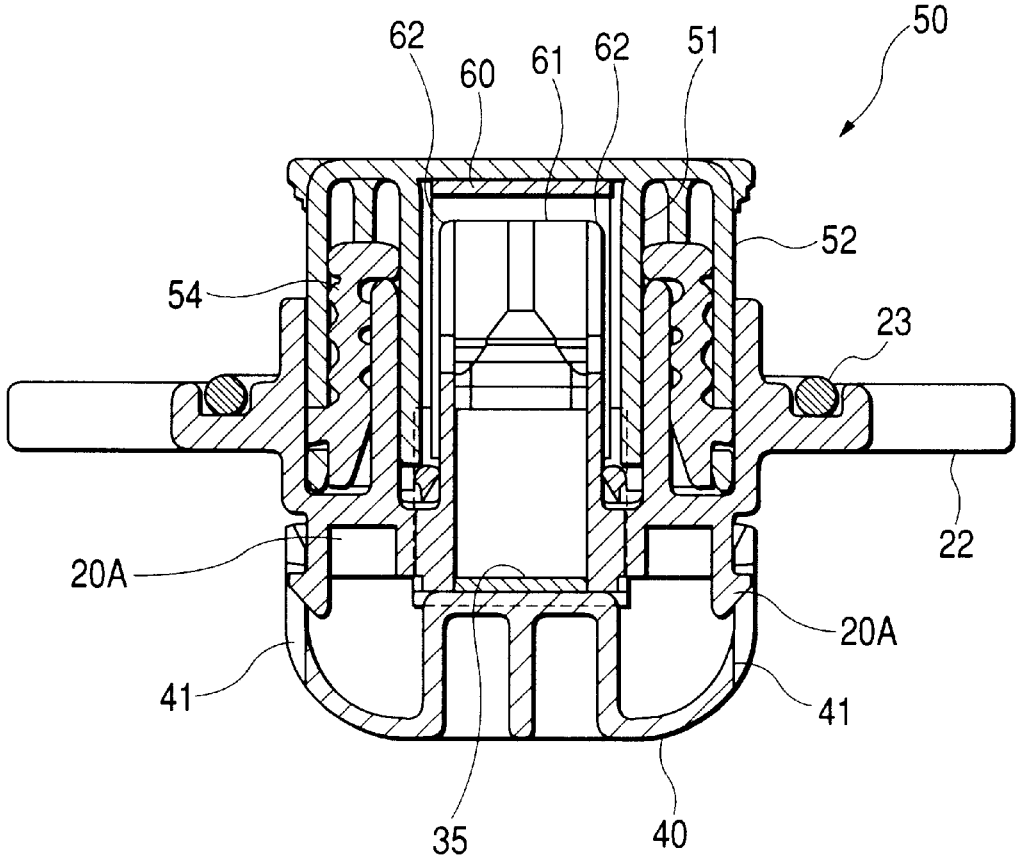
FIG. 2 is a longitudinal cross-sectional view of a breaker device of an embodiment of the present invention, wherein the view is taken in another direction.

The lower housing 40 is like a container having a shallow bottom and covers an opening lower face of the upper housing 20. As shown in FIG. 2, when a plurality of engaging pawls 20A formed at the lower end of the upper housing 20 are engaged with the engaging holes 41 formed on the side wall of the lower housing 40, both the housings 20 and 40 are integrated with each other into one body.

On the other hand, the plug 50 is detachably attached to the breaker section 30 of the upper housing 20. This plug 50 is formed into a double cylinder, the upper face of which is closed. The inner cylinder 51 is capable of engaging with the inside of the guide cylinder 33 of the upper housing 20. The outer cylinder 52 is capable of engaging with the inside of the engaging cylinder 34 of the upper housing 20. Inside the inner cylinder 51, there is provided a movable electrode 60, which is composed of a U-shaped conductive plate, under the condition that the lower side of the movable electrode 60 is open. This movable electrode 60 is held by the stop ring 53 so that it can not be drawn out. In the outer cylinder 52, there is provided an annular water-proof seal 54 which is tightly interposed between the outer cylinder 52 and the outer circumferential face of the guide cylinder 33 of the upper housing 20. In this connection, in the outermost circumferential section of this plug 50, the engaging arm 55 is integrally molded while an upper portion of the engaging arm 55 is a free end. When the engaging pawls 56 protruding from the engaging arm 55 are engaged with the engaging holes 34A formed in the engaging cylinder 34 of the upper housing 20, the plug 50 can be fixed to the breaker section 30.

At an upper end of the protruding wall 32 formed in the breaker section 30, there are provided a pair of protective protruding sections 61 which cover upper portions of the two stationary electrodes 35. Each protective protruding section 61 is formed like a cantilever, the upper end section of which is integrally continued to the upper end section of the protruding wall 32. Each protective protruding section 61 is formed into a fan-shape in which the protective protruding section 61 is separate from the protruding wall 32 as it comes downward. The lower end of the protective protruding section 61 comes into contact with the upper end of the stationary electrode 35 and covers an upper portion of the stationary electrode 35.

Figure 5:
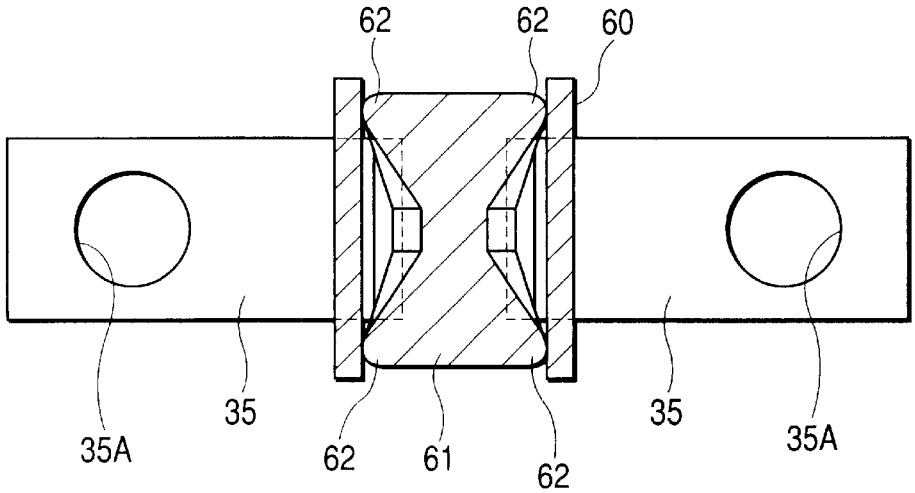
FIG. 5 is an enlarged lateral cross-sectional view showing a relation between a stationary electrode and a movable electrode of an embodiment of the present invention.

As shown in FIG. 5, the center of each protective protruding section 61 is recessed in the inserting direction of the movable electrode 60. Accordingly, protrusions 62 are protruded from both side edge sections of the protective protruding section 61. Each protrusion 62 is protruded at a position shifted from the stationary electrode 35, that is, each protrusion 62 is protruded at a position shifted from both sides of the stationary electrode in the width direction in such a manner that each protrusion 62 is separate from the face of the stationary electrode 35.

The breaker device of this embodiment is attached to, for example, an electric automobile under the condition that the upper 20 and the lower housing 40 are integrated with each other into one body. In order to close the circuit by this breaker device, the plug 50 is attached to the breaker section 30. In order to open the circuit, the plug 50 is drawn out from the breaker section 30.

When the plug 50 is attached, first, an opening end (lower end) of the movable electrode 60 comes into contact with the protective protruding section 61 of the upper housing 20. Due to the foregoing, the movable electrode 60 is elastically expanded and passes through the protective protruding section 61. After the movable electrode 60 has passed through the protective protruding section 61, the movable electrode 60 is closed by an elastic force. When the movable electrode 60 comes into contact with both the stationary electrodes 35, both the stationary electrodes 35 can be electrically short-circuited to each other.

In the above closing motion of the circuit, the movable electrode 60 is expanded when it comes into contact with the protrusions 62 located on both sides of the protective protruding sections 61 in the width direction. Accordingly, there is no possibility that the movable electrode 60 rubs the entire face of the protective protruding section 61. Also, there is no possibility that the movable electrode 60 makes the face of the protective protruding section 61 wear away. There is a possibility that the movable electrode 60 rubs and scrapes off the protrusions 62. However, even in a case in which powder is generated when the movable electrode 60 scrapes off the protrusions 62, since the protrusions 62 are formed at positions shifted from the stationary electrode 35 with respect to the inserting direction of the movable electrode 60, there is no possibility that the scraped powder of resin is interposed between the stationary electrode 35 and the movable electrode 60. Further, there is no possibility that the electrical contact becomes unstable.

Of course, according to the arrangement of this embodiment, a pair of stationary electrodes 35 are collected in a portion while the protruding wall 32 is interposed between them. Therefore, the structure in the periphery of the stationary electrodes 35 is composed so compact that the breaker device can be downsized. Further, since the insulating protective protrusion 61 to cover a forward end face of the stationary electrode 35 is provided at the forward end portion of the protruding wall 32, even if a worker's finger or a foreign matter enters the breaker device from an upper portion of the stationary electrode 35, it is possible to prevent it from coming into contact with the stationary electrode 35.

Another Embodiment

The present invention is not limited to the specific embodiment. For example, the following embodiments are included in the technical scope of the present invention. Further, variations may be made by one skilled in the art without departing from the spirit and scope of the present invention.

Figure 6:
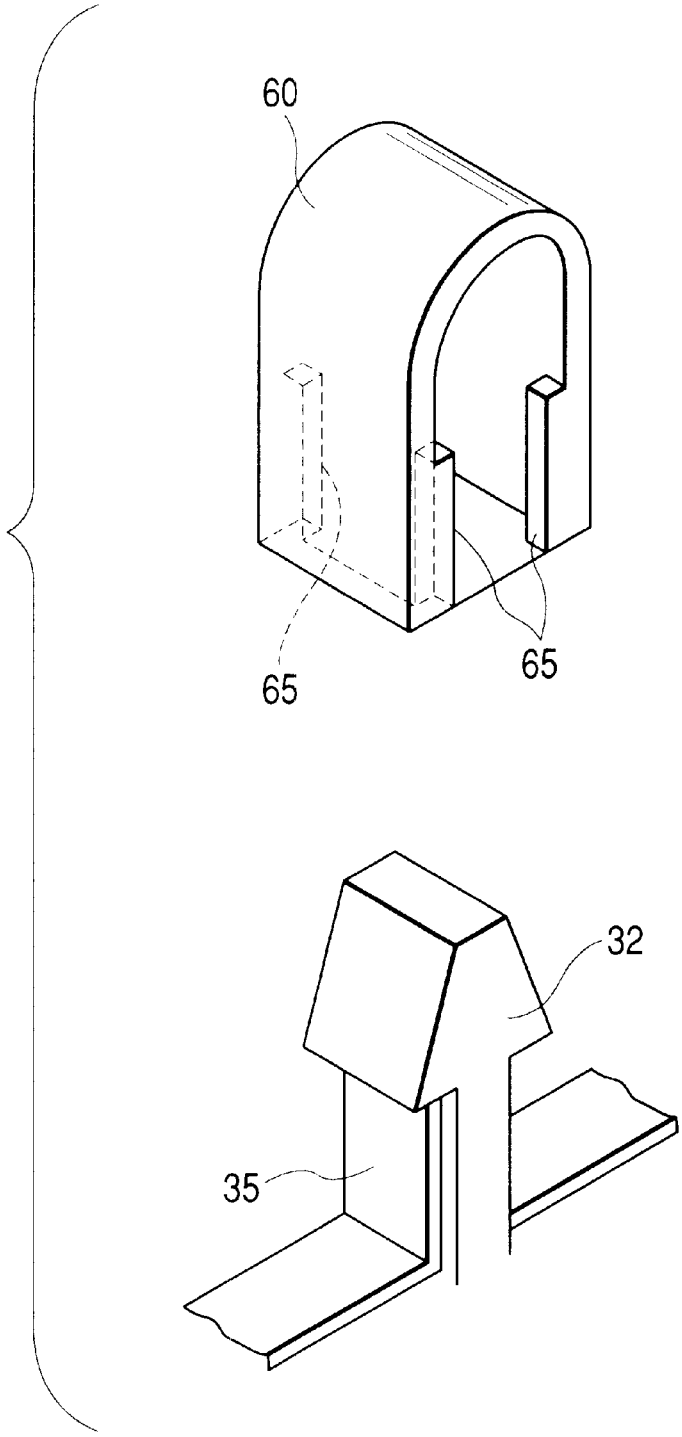
FIG. 6 is a perspective view showing another embodiment of the present invention.
Figure 7:
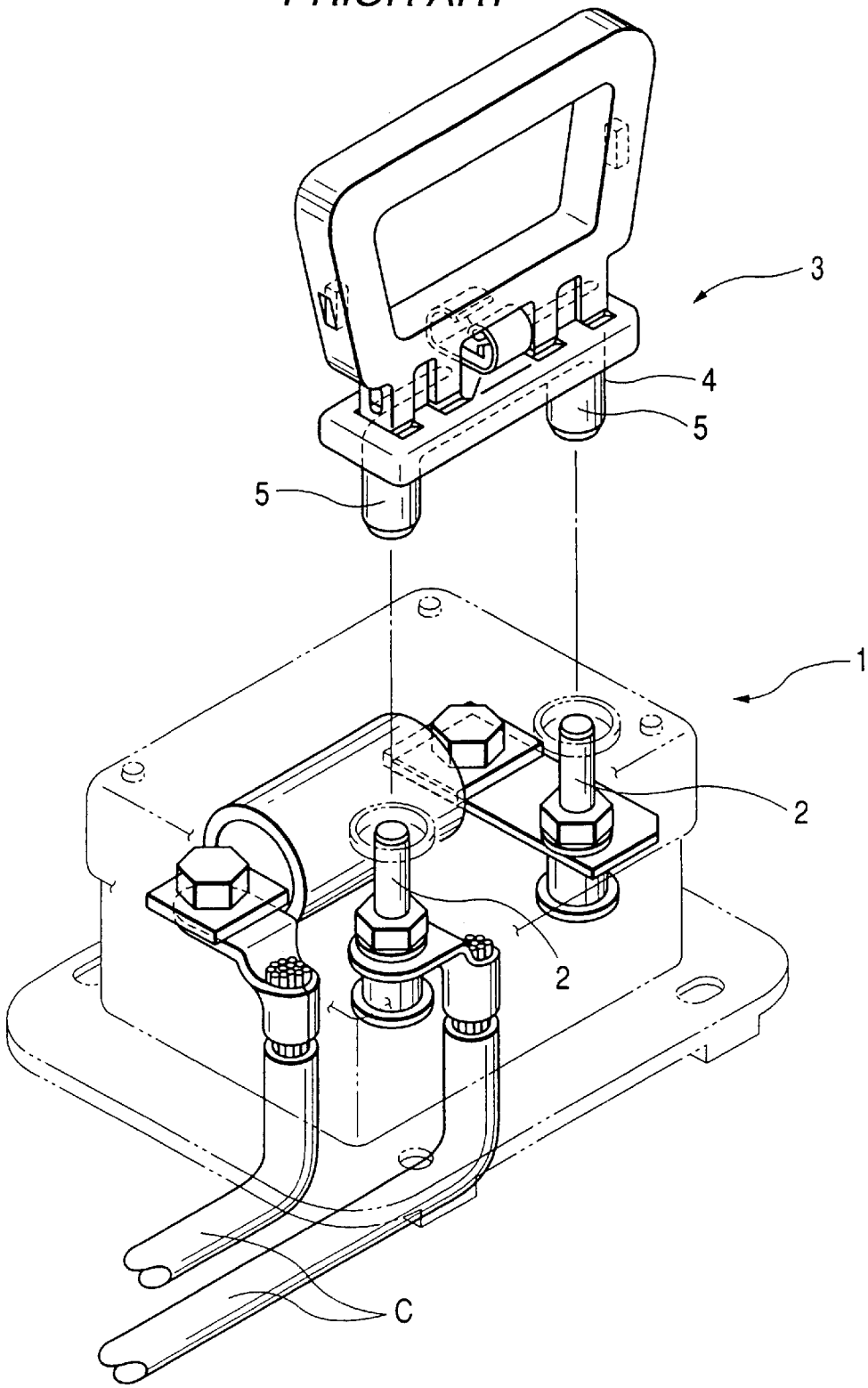
FIG. 7 PRIOR ART
FIG. 7 is a perspective view showing a conventional breaker device.
Figure 8:
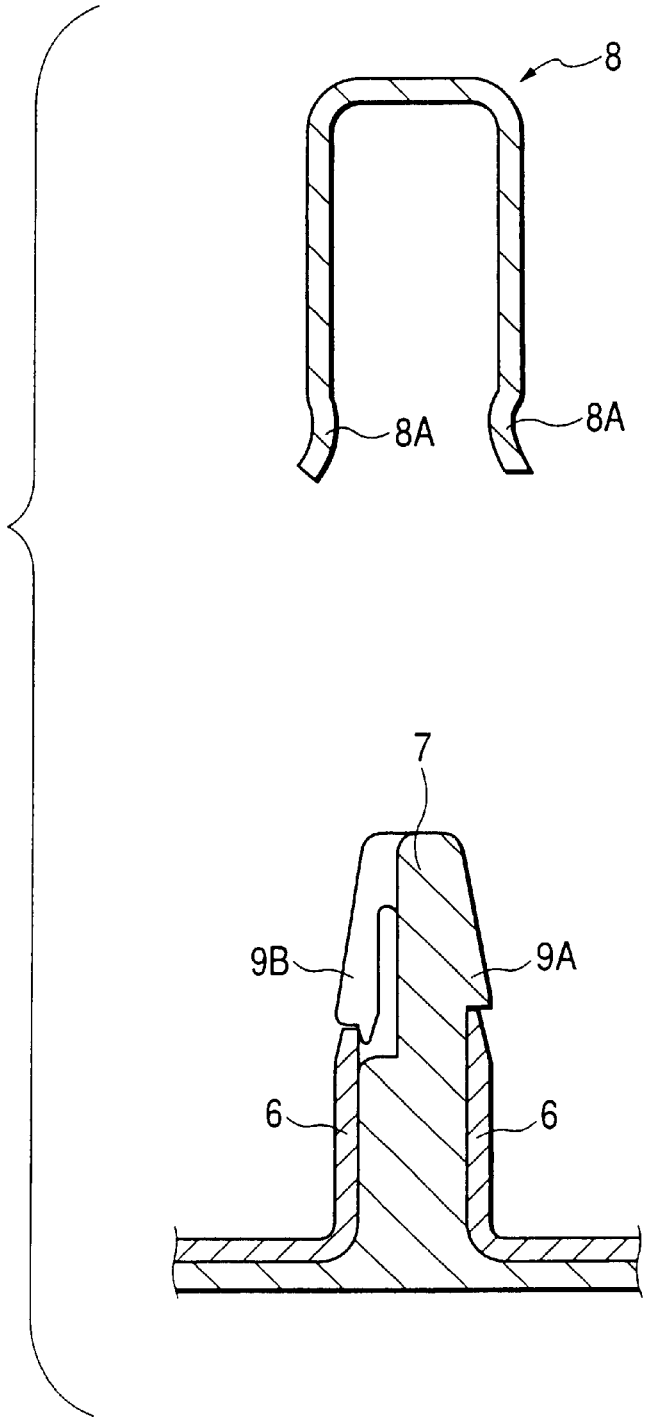
FIG. 8 PRIOR ART
FIG. 8 is a cross-sectional view showing a breaker device of a reference example.

(1) In the above embodiment, the protrusions 62 are provided on the protruding wall 32. However, the present invention is not limited to the above specific embodiment. As shown in FIG. 6, the protrusions 65, 65 may be provided on the side of the movable electrode 60. In this case, the lateral width of the movable electrode 60 is made larger than that of the stationary electrode 35, and the protrusions 65, 65 are formed at both side edge sections of the movable electrode 60 in the width direction. Due to the foregoing, the protrusions 65 can be formed at positions shifted from the stationary electrode 35 with respect to the inserting direction of the movable electrode 60.

(2) In the breaker device of each embodiment described above, the fuse 25 is accommodated. However, it is possible to apply the present invention to a breaker device having no fuse.

(3) In each embodiment described above, two protrusions 62 are respectively provided on both sides of the protective protruding section 61. However, for example, it is possible to adopt an arrangement in which one protrusion is provided on the side of one protective protruding section. Alternatively, it is possible to adopt an arrangement in which one protrusion is provided in the middle of two protective protruding sections.

What is claimed is:

1. A breaker device comprising:

a pair of stationary electrodes arranged on opposite sides of an insulating protruding wall; and a movable electrode for short-circuiting said stationary electrodes to each other by putting said movable electrode on said stationary electrodes from a forward end side of said protruding wall, wherein an insulating protective protruding section for covering a forward end face of said stationary electrodes from the forward end side of said protruding wall is provided at the forward end of said protruding wall, and a protrusion for expanding said movable electrode is provided in the forward end of said protruding wall or said movable electrode at a position shifted from said stationary electrode.

2. The breaker device according to claim 1, wherein said protrusion is formed protruding from the forward end of said protruding wall in a direction so that said protrusion is more separate from a face of each of said stationary electrodes than said protective protruding section.

3. The breaker device according to claim 1, wherein said protrusion is formed in said movable electrode while said protrusion is protruding onto said protruding wall side.

4. The breaker device according to claim 1, wherein said protrusion is provided on opposite sides of said stationary electrode in a width direction.

* * * * *